United States Patent [19]

Finney

[11] 4,082,151

[45] Apr. 4, 1978

[54] CAM MOUNTING FOR AN IMPACT TOOL

[75] Inventor: James L. Finney, Cranbury, N.J.

[73] Assignee: Hughes Tool Company, Houston, Tex.

[21] Appl. No.: 759,502

[22] Filed: Jan. 14, 1977

[51] Int. Cl.[2] ..... B25D 9/00

[52] U.S. Cl. ..... 173/119; 173/123

[58] Field of Search ..... 173/119, 120, 123, 139; 74/56

[56] References Cited

U.S. PATENT DOCUMENTS

| | | | |
|---|---|---|---|
| 3,256,946 | 6/1966 | Jansen et al. | 173/123 |
| 3,302,732 | 2/1967 | Roll | 173/123 |
| 3,322,208 | 5/1967 | Skoog | 173/120 |
| 3,566,978 | 3/1971 | Voert | 173/139 |
| 3,774,700 | 11/1973 | Shepherd | 173/119 |

*Primary Examiner*—Robert A. Hafer

*Attorney, Agent, or Firm*—Robert A. Felsman

[57] ABSTRACT

A motor driven cam and spring impact tool with an improved mounting for the cam. The impact tool includes a driving shaft for rotation relative to the housing. A hammer is positioned in the housing for axial movement with respect to the housing. An annular cam with cam rollers translates the rotational motion of the driving shaft to reciprocating motion of the hammer. A spring urges the hammer in one direction to cause an impact upon each reciprocation. A collar, driven by the shaft, is connected to the cam or selectively to the rollers for rotating one with respect to the other. The non rotating member is attached to the hammer to cause reciprocation. A pair of pins are connected between the cam and selectively the collar or hammer, and spaced apart 180° to allow the cam to tip about the axes of the pins. This equalizes the load imposed by the rollers upon the cam.

6 Claims, 4 Drawing Figures

Fig. 1
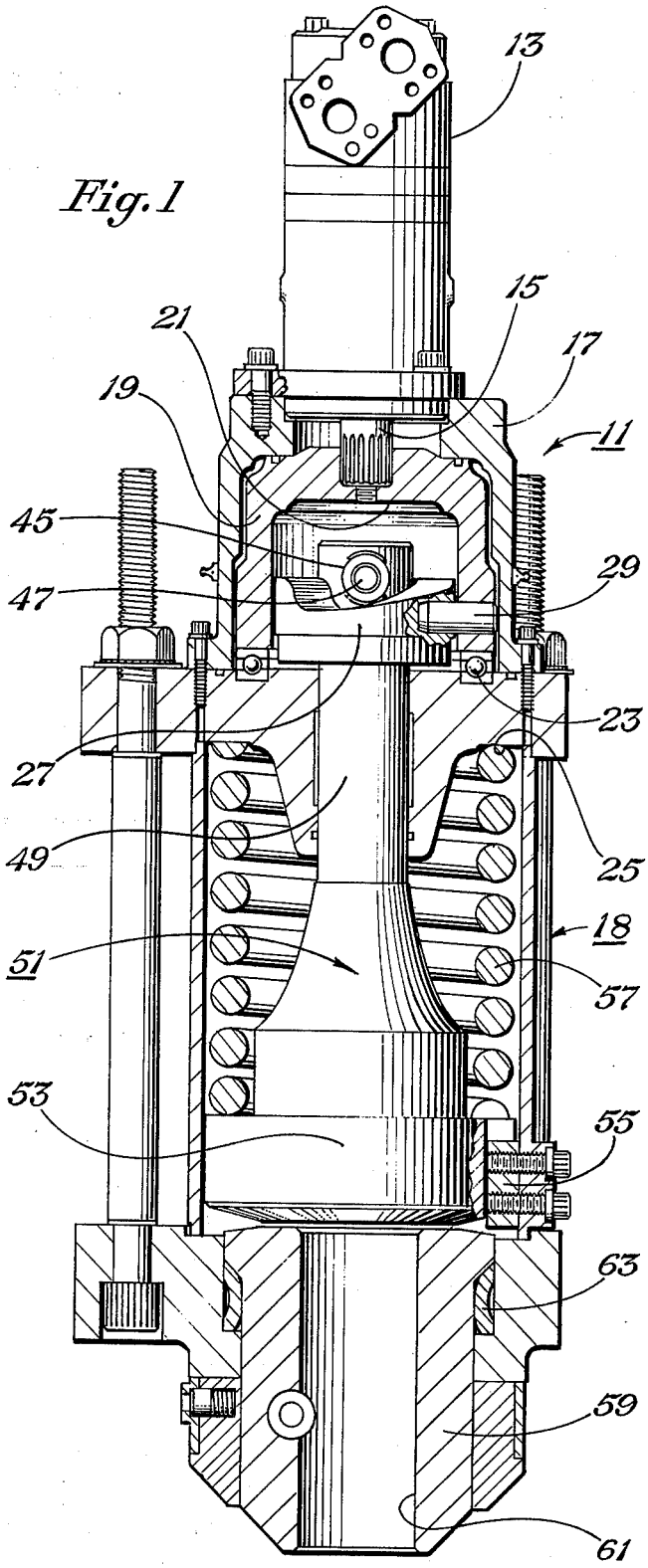
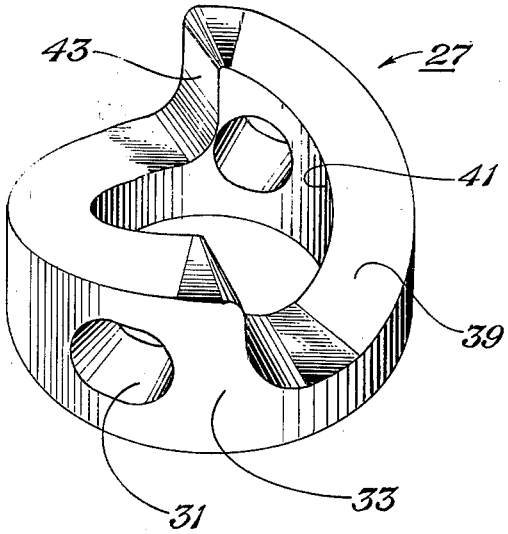
Fig. 2

CAM MOUNTING FOR AN IMPACT TOOL

BACKGROUND OF THE INVENTION

1. Field of the Invention

This invention relates in general to impact tools and in particular to an improved motorized impact tool using a spring and cam to cause reciprocating impacts.

2. Description of the Prior Art

Cam and spring impact tools normally include a driving shaft rotated by a motor, a hammer mounted for reciprocation, and a cam and roller assembly for translating rotational motion to reciprocation. A spring urges the hammer in one direction to create the impact. The cam is annular with a double inclined camming surface. A pair of cam rollers are rotated, the rise and fall causing the reciprocation of the hammer.

Because of inaccuracies in machining the camming surface and the connection of the rollers to the driving shaft, inequalities of the load of the cam rollers on the camming surface may result, causing wear and breakage. In U.S. Pat. 3,302,732, the transverse axle on which the cam rollers are mounted is slightly larger in the center than at the ends. This allows the rollers to tip slightly about the axis to equalize the load. While this barrel shaped axle performs satisfactorily, machining cost are expensive.

SUMMARY OF THE INVENTION

It is accordingly a general object to provide an improved motor driven cam and spring impact tool.

It is a further object to provide an improved structure in a cam and spring impact tool for equalizing the load of the cam rollers on the cam.

It is a further object to provide a cam mounting that allows the cam to tip for equalizing the load imposed by the cam rollers.

In accordance with these objects, an improved impact tool is provided wherein the cam is mounted on a pair of transverse pins. The pins are spaced apart on the annular cam 180° so that their axes coincide. The cam and pins are rotatable with respect to each other, allowing the cam to tip about the common axis of the pins. This equalizes the load imposed by the rollers, without requiring a barrel shaped axle for the rollers.

BRIEF DESCRIPTION OF THE DRAWINGS

FIG. 1 is an elevational view, partially in section of an impact tool constructed in accordance with this invention.

FIG. 2 is a perspective view of the annular cam utilitized in FIG. 1.

DESCRIPTION OF THE PREFERRED EMBODIMENT

Figure 3:
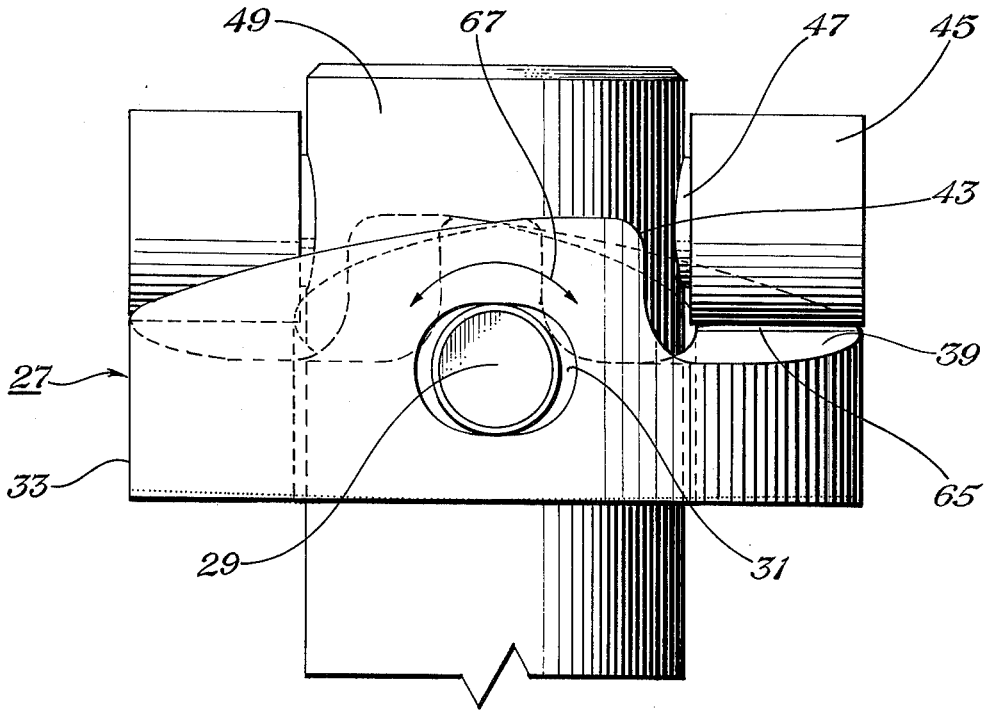
FIG. 3 is an enlarged elevational view of the cam and upper portion of the hammer used in the impact tool of FIG. 1.

An impact tool is shown in FIG. 1, including a hydraulic motor 13 for rotating a splined driving shaft 15 mounted inside bearing carrier 17, which forms a part of housing 18. A transmission means comprising a cylindrical collar 19 has mating splines on its closed end 21 for transmitting the rotational force of the driving shaft 15. The open end or edge of the collar 19 faces in the direction opposite from the driving shaft 15, and is supported on ball bearings 23, which in turn are supported by an internal partition 25 of the housing 18.

Figure 4:
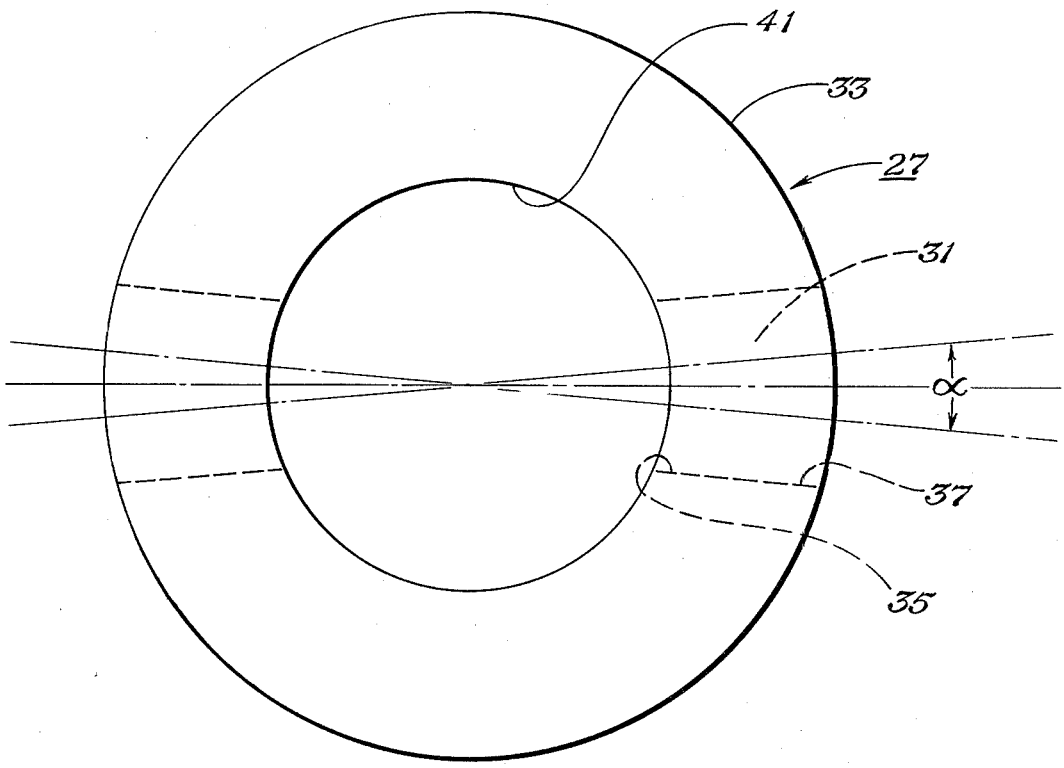
FIG. 4 is a bottom plan view of the annular cam used in the impact tool of FIG. 1.

An annular cam 27, shown also in FIGS. 2–4, is connected to and driven by collar 19. Two cylindrical pins 29 are carried in holes in the sidewall of the collar 19. The pins 29 extend into holes or bores 31 in the sidewall 33 of cam 27. Holes 31 are spaced on opposite sides of cam 27, 180° apart, so that the axes of the pins 29 coincide. Clearances exist between the cam sidewalls 33 and the collar 19 and between the lower surface of cam 27 and the housing to allow it to tilt about the axis of pins 29. The holes provided in the collar 19 for the pins 29 are cylindrical, however holes 31 are wider than the pins 29 in the transverse or rotational direction. This allows the cam to rotate a selected distance $\alpha$ with respect to pins 29 as shown in FIG. 4. The inner side 35 of hole 31 is approximately cylindrical, while the outer side 37 of hole 31 is enlarged or elongated along a circumferential portion of side wall 33. Preferably the enlargement is sufficient to allow a "backlash" angle $\alpha$ of 10°.

Cam 27 has an annular camming surface 39 which faces toward the end 21 of collar 19 and surrounds a center aperature 41. Camming surface 39 has two inclined surfaces, with two drop off shoulders 43. Holes 31 are substantially aligned vertically with the highest or thickest part of the cam, which is just prior to the drop off shoulders 43.

A pair of cam rollers 45 are journalled on a transverse axle 47 and spaced apart so as to roll over cam surface 39. Axle 47 extends through the upper shaft 49 of a hammer or striker 51. Hammer 51 is mounted in housing 18 so as to be capable of axial movement with respect to the housing and driving shaft 15. Hammer 51 is guided at its shaft 49 by the internal shoulder 25 of the housing, and guided at its enlarged striking end 53 by guide 55. The upper end of shaft 49 extends slidingly through the center aperture 41 of the cam, with the axle 47 and rollers 45 disposed between the camming surface 39 and the closed end 21 of collar 19. The common axis of the pins 29 are perpendicular to the axis of the hammer. A coil spring 57 encircles portions of hammer 51, and is pre-compressed to a selected force between internal shoulder 25 of the housing 18 and the enlarged portion 53 of the hammer.

A tool guide 59 is mounted to housing 18 at the base of enlarged portion 53 of the hammer. An axial passage 61 in tool guide 59 receives a working tool (not shown) which contacts the material desired to be broken out. A buffer spring 63 is mounted between tool guide 59 and partition 25, to absorb blows should the working tool not be in solid contact with the work piece.

In operation, the hydraulic motor 13 rotates the drive shaft 15 and collar 19. Cam 27 is thereby rotated by pins 29, which transmit the rotation force. Camming surface 39 engages the cam rollers 45, as shown in FIG. 3, to cause the hammer 51 to move axially toward the driving shaft 15, further compressing coil spring 57. As the cam rotates the drop off points 43 past the cam rollers 45, the cam rollers 45 are pulled by the spring toward the lowest portion of the camming surface 39. The force of the spring causes the working tool to strike the work piece with a large force. Should the working tool be fully extended or break through the work piece, enlarged portion 53 of the hammer strikes tool guide 59.

As the cam 27 is rotated clockwise as seen from the top, the pins 29 will be driving against holes 31 on the forward side. At the moment when the cam rollers 45 are at the drop off shoulders 43, a component of the force of spring 57 causes cam 27 to shift forward with respect to pins 29 a circumferential distance equivalent to the angle $\alpha$. This backlash allows the cam rollers 45 to drop more easily, with less force exerted on the shoulder at the drop-off points 43, reducing wear. Once the cam rollers begin climbing the inclined surface, pins 29 move forward or clockwise with respect to cam 27 a circumferential distance to the angle $\alpha$.

The cam rollers 45 do not contact the camming surface 39 after dropping off until the cam drop off shoulders 43 have been rotated past the cam rollers 45 approximately 30°. Once the cam rollers begin contacting the inclined surface again, should one roller contact the camming surface prior to the other, as shown by the gap indicated as numerals 65 in FIG. 3, then the cam is free to tip about the axes of the pins 29, as indicated by arrows 67 and phantom lines. This equalizes the load imposed by the cam rollers on the cam.

It should be apparent that an invention having significant improvements has been provided. The cam is free to tip about the pins' axis to equalize the load, avoiding bending and breaking. The axle for the roller is cylindrical, avoiding expensive machining required to achieve the former barrel shape.

While the invention has been shown in only one of its forms, it should be apparent to those skilled in the art that it is not so limited but is susceptible to various changes and modifications without departing from the spirit thereof.

I claim:

1. In a motor driven cam and spring means impact tool having a housing, a driving shaft mounted in the housing for rotation relative to the housing, a hammer positioned in the housing for axial movement with respect to the driving shaft, an annular camming assembly having components including a cam and a pair of cam rollers mounted on opposite sides of the hammer for translating rotational motion of the driving shaft to reciprocal motion of the hammer, and transmission means connected to the driving shaft and to the camming assembly to rotate one of the components with respect to the other, the non rotating component being attached to the hammer, and improved mounting for the cam comprising:

a pair of pins each having one end inserted in a bore in the cam formed transverse to the axis of the driving shaft, the other end carried selectively by the transmission means and the hammer, the pins being spaced apart 180° and each having at least one of its ends slidingly received; the cam being mounted in the housing so that it is free to tip about the axis of the pins to equalize the load imposed by the cam rollers on the cam.

2. The apparatus according to claim 1 wherein the pins are carried by the transmission means.

3. The apparatus according to claim 2 wherein the transmission means comprises:

a cylindrical collar with the driving shaft mating in its closed end and its walls encircling the cam.

4. The apparatus according to claim 2 wherein the pins are located adjacent the highest level of the cam.

5. In a motor driven impact tool having a housing, a driving shaft mounted in the housing for rotation relative to the housing, a hammer positioned in the housing for axial movement with respect to the driving shaft, an annular cam encircling the hammer, a pair of cooperating cam rollers mounted to the hammer on opposite sides by an axle mounted transverse to the axis of the hammer for translating rotational motion of the driving shaft to reciprocal motion of the hammer, and spring means for urging the hammer in one direction to provide an impact, an improved cam mounting comprising:

transmission means, connected to the driving shaft for rotating the cam with respect to the housing, the transmission means being pivotally connected to the cam, and the cam being mounted within the housing so that the cam is free to pivot about a line substantially perpendicular to the axis of the hammer to equalize the load of the cam rollers on the cam.

6. A motor driven impact tool comprising in combination:

a housing, a driving shaft mounted in the housing for rotation relative to the housing;

a hammer with a striking end positioned in the housing for axial movement with respect to the housing;

a cylindrical collar having a closed end connected to the driving shaft and an open end mounted on bearings to the housing;

an annular cam having two inclined camming surfaces and being mounted to the collar by a pair of pins inserted in apertures formed in the cam transverse to the axis of the hammer and spaced apart substantially 180°;

a pair of cooperating cam rollers engaging the camming surface and mounted to the hammer on an axle extending transverse to the axis of the hammer; and a spring mounted between the hammer and the housing for urging the hammer in one direction to provide an impact;

clearances being provided about the cam so that the cam is free to tilt on the axis of the pins to equalize the load between the cam rollers and the camming surfaces.

* * * * *